United States Patent [19]

Stellaccio

[11] 4,443,230

[45] Apr. 17, 1984

[54] PARTIAL OXIDATION PROCESS FOR SLURRIES OF SOLID FUEL

[75] Inventor: Robert J. Stellaccio, Spring, Tex.

[73] Assignee: Texaco Inc., White Plains, N.Y.

[21] Appl. No.: 499,620

[22] Filed: May 31, 1983

[51] Int. Cl.[3] ..... C10J 3/46

[52] U.S. Cl. ..... 48/197 R; 48/206; 48/DIG. 7; 252/373

[58] Field of Search ..... 48/197 R, 203, 202, 48/206, 209, DIG. 7, 86 R; 252/373; 239/422, 423, 424

[56] References Cited

U.S. PATENT DOCUMENTS

| | | | |
|---|---|---|---|
| 3,945,942 | 3/1976 | Marion et a. | 252/373 |
| 4,113,445 | 9/1978 | Gettert | 48/197 R |
| 4,351,647 | 9/1982 | Marion et al. | 48/197 R |
| 4,386,941 | 6/1983 | Crouch et al. | 48/197 R |

*Primary Examiner*—Peter F. Kratz

*Attorney, Agent, or Firm*—Robert A. Kulason; Robert Knox; Albert Brent

[57] ABSTRACT

A partial oxidation process including a burner is provided for introducing four separate feedstreams including a stream of gaseous material from the group free-oxygen containing gas, steam, recycle product gas, and hydrocarbon gas; a pumpable slurry of solid carbonaceous fuel in liquid phase e.g. coal-water; and two high velocity streams of free-oxygen containing gas into a free-flow partial oxidation gas generator for the production of synthesis gas, fuel gas, or reducing gas. The burner has a central conduit and three concentric annular passages. A central core of a gas selected from the group consisting of free-oxygen containing gas, steam, recycle product gas, and hydrocarbon gas surrounded by the slurry of solid carbonaceous fuel is discharged from the central conduit and first annular passage respectively and is impacted by two separate streams of free-oxygen containing gas passing through the second and outer annular passages. With this burner, at least one stream of high velocity free-oxygen containing gas is always available, even at turn-down, to provide atomization and intimate mixing of the slurry feed.

14 Claims, 1 Drawing Figure

PARTIAL OXIDATION PROCESS FOR SLURRIES OF SOLID FUEL

BACKGROUND OF THE INVENTION

This invention relates to the manufacture of gaseous mixtures comprising $H_2$ and CO, e.g., synthesis gas, fuel gas, and reducing gas by the partial oxidation of pumpable slurries of solid carbonaceous fuels in a liquid carrier. In one of its more specific aspects, the present invention relates to an improved burner for such gas manufacture.

Annulus-type burners have been employed for introducing feedstreams into a partial oxidation gas generator. For example, a single annulus burner is shown in coassigned U.S. Pat. No. 3,528,930, and double annulus burners are shown in coassigned U.S. Pat. Nos. 3,758,037 and 3,847,564. To obtain proper atomization, mixing, and stability of operation, a burner for the partial oxidation process is sized for a specific throughput. Should the required output of product gas change substantially, shut-down of the system is required in order to replace the prior art burner with one of proper size. This problem is avoided and costly shut-downs are eliminated by using the subject burner which will operate at varying levels of output while retaining axial symmetry, stability, and efficiency.

SUMMARY OF THE INVENTION

A high turndown burner is provided for simultaneously introducing four separate feedstreams into a free-flow partial oxidation gas generator for the production of synthesis gas, fuel gas, or reducing gas. The separate feedstreams comprise a stream of gaseous material from the group consisting of free-oxygen containing gas, steam, recycle product gas, and hydrocarbon gas; a pumpable slurry stream of solid carbonaceous fuel in liquid phase e.g. coal-water; and two streams of free-oxygen containing gas.

The burner has a high turndown capability and includes a central cylindrical conduit and second, third, and outer cylindrical conduits which are radially spaced from each other to provide first, second, and outer annular coaxial concentric annular passages. The conduits are coaxial with the central longitudinal axis of the burner. All of the conduits and annular passages are closed at the upstream ends and open at the downstream ends. The inside and outside diameters of the central conduit are reduced near the downstream end of the burner to form a cylindrical shaped nozzle. The first annular passage ends with a converging frustoconical annular portion that develops into a right cylindrical portion near the downstream end of the burner. The second and outer annular passages develop into converging frustoconical shaped portions near the downstream end of the burner. A water-cooled annular ring is provided for cooling the tip of the burner. Cooling coils are also wrapped around the downstream end of the burner.

A central core comprising a stream of gas selected from the group consisting of free-oxygen containing gas, steam, recycle product gas, and hydrocarbon gas from the central conduit surrounded by the slurry stream of solid carbonaceous fuel from the first annular passage are discharged from the downstream portion of the burner. These steams are impacted by the two separate streams of free-oxygen containing gas passing through the second and outer annular passages at high velocity. Atomization and intimate mixing of the slurry feed with the free-oxygen containing gas mainly takes place in the reaction zone. However, in one embodiment the tips of the central, second and third conduits are retracted and some mixing may take place prior to or at the outer conduit exit orifice. In such case the high bulk velocity of the mixture of slurry of solid carbonaceous fuel and free-oxygen containing gas optionally in admixture with a temperature moderator is maintained across the exit of the burner. Advantageously by means of the subject burner, a high velocity stream of annular free-oxygen containing gas is always available, even at turndown for atomizing and mixing with the slurry. The velocity of the free-oxygen containing gas may be maintained at near optimum value to disperse the slurry of solid carbonaceous fuel. Throughput may be varied—up or down—over a wide range. Further, axial symmetry for the reactant flow pattern is maintained.

BRIEF DESCRIPTION OF THE DRAWING

In order to illustrate the invention in greater detail, reference is made to an embodiment shown in the drawing wherein.

DESCRIPTION OF THE INVENTION

Figure 1:
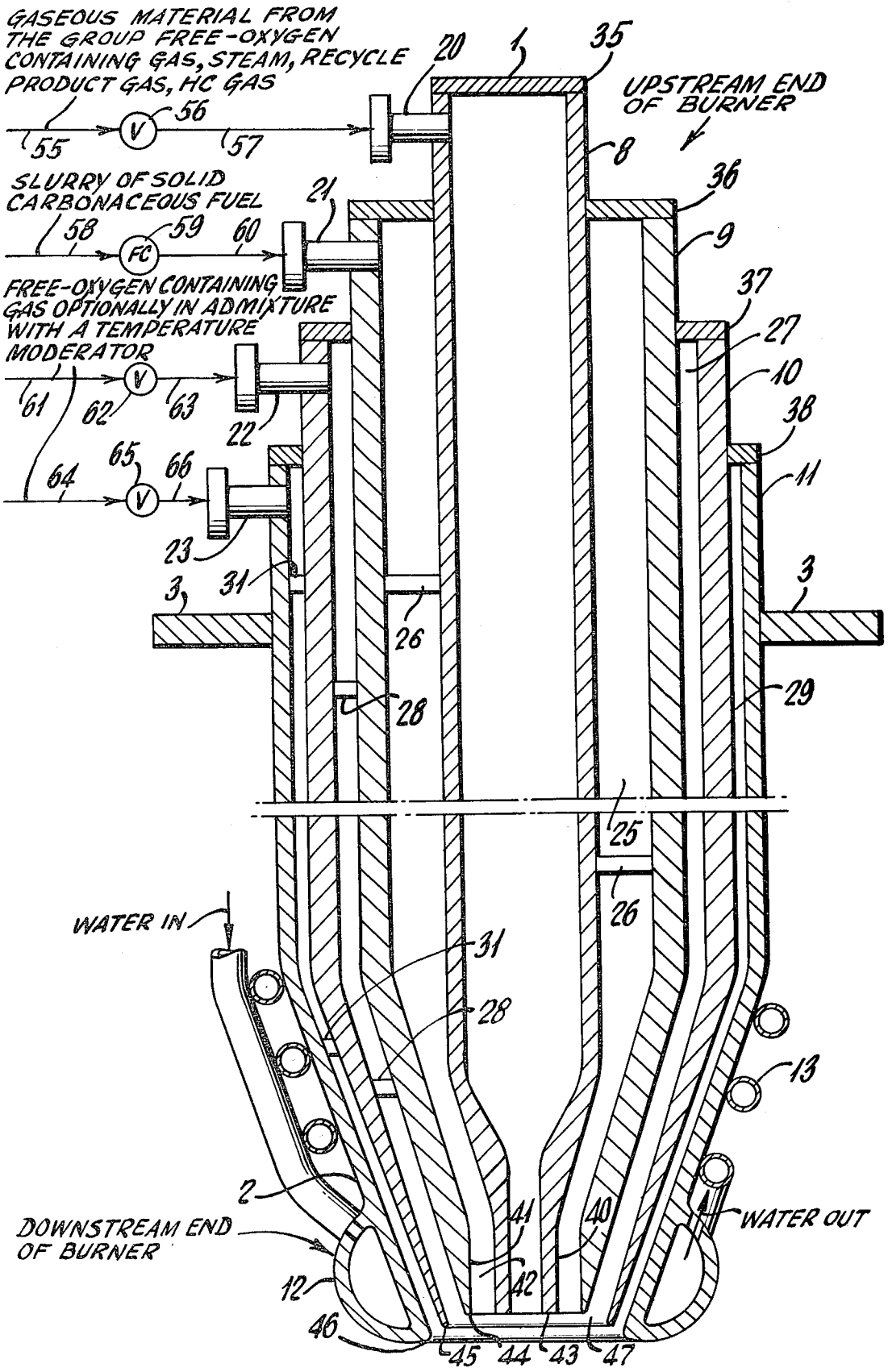
FIG. 1 is a transverse longitudinal cross-section through the upstream and downstream ends of the burner.

The present invention pertains to a novel burner for use in the non-catalytic partial oxidation process for the manufacture of synthesis gas, fuel gas, or reducing gas. The burner is preferably used with a reactant fuel stream comprising a pumpable slurry of solid carbonaceous fuel in a liquid carrier. By means of the burner, a reactant feedstream of free-oxygen containing gas with or without admixture with a temperature moderator is mixed with the reactant fuel stream and optionally with a gaseous material. Atomization and mixing mainly takes place in the reaction zone of a conventional partial oxidation gas generator. However, in one embodiment some mixing may take place prior to or at the tip of the burner.

A hot raw gas stream is produced in the reaction zone of the non-catalytic, refractory-lined, free-flow partial oxidation gas generator at a temperature in the range of about 1700° to 3500° F. and a pressure in the range of about 1 to 300 atmospheres, such as about 5 to 250 atmospheres, say about 10 to 100 atmospheres. A typical partial oxidation gas generator is described in coassigned U.S. Pat. No. 2,809,104. The effluent raw gas stream from the gas generator comprises $H_2$ and CO. One or more of the following materials are also present: $CO_2$, $H_2O$, $N_2$, A, $CH_4$, $H_2S$ and COS. Depending on the fuel and operating conditions, entrained matter e.g. particulate carbon-soot, fly-ash, or slag may be produced along with the raw gas stream.

The burner comprises a central cylindrical conduit having a central longitudinal axis that is coaxial with the central longitudinal axis of the burner and a converging nozzle that develops into a right cylindrical section of smaller diameter at the downstream end. Second, third and outer cylindrical conduits are radially spaced and are coaxial and concentric with the central conduit along its length. An unobstructed converging exit nozzle is located at the downstream end of each conduit. The converging portion of the inside surface of the second conduit and the outside surface of the central conduit develop into straight cylindrical portions near their downstream ends. Conventional separators are used for radially spacing the conduits from each other and forming therebetween first, second, and outer unobstructed annular passages. For example, alignment pins, fins, centering vanes, spacers and other conventional means are used to symmetrically space the conduits with respect to each other and to hold same in stable alignment with minimal obstruction to the free-flow of the feedstreams.

Near the downstream end of the first annular passage is a converging frustoconical annular portion that develops into a right cylindrical annular portion. Near the downstream ends of the second and outer annular passages are converging frustoconical annular portions. The conduits and annular passages are closed off at their upstream ends by conventional means that provide a gastight seal e.g. flanges, plates or screw caps. A flanged inlet is in communication with the upstream end of each conduit for introducing the following feedstreams: (1) central conduit—a gaseous material from the group consisting of free-oxygen containing gas, steam, recycle product gas, and hydrocarbon gas; (2) second conduit—slurry of solid carbonaceous fuel; (3) third conduit—a high velocity stream of free-oxygen containing gas; and (4) outer conduit—a high velocity stream of free-oxygen containing gas.

Near their downstream ends, the second and outer annular passages converge towards the central longitudinal axis at converging angles in the range of about 15° to 60°, such as about 20° to 40°. The second and outer annular passages may be parallel towards their downstream ends; or the converging angle between portions of the second and outer annular passages towards their downstream ends may be in the range of about 0° to 90°, such as about 5° to 15°.

The inside diameters of the discharge orifices for the central, second, third, and outer conduits are progressively increasing. The discharge orifices for the central conduit and the second, third, and outer conduits may be located in the same plane at the tip of the burner or retracted upstream from the circuit exit orifice for the outer conduit, which is preferably at the tip (downstream extremity) of the burner.

Thus, the tips of the central, second, and third conduits may have 0 retraction with respect to the tip for the outer conduit, or they may be progressively, or nonprogressively retracted upstream. For example, if Do represents the diameter of the circular exit orifice at the tip of the outer conduit, then the tip of the central, second and third conduits may be retracted upstream from the outer conduit circular exit orifice by the amount shown in the following Table I.

TABLE I

| | Retraction Upstream From the Outer Conduit Circular Exit Orifice(Do) at the Tip of the Burner |
|---|---|
| Tip of Central Conduit | 0 to 2.0 × Do; such as about 0 to 1.0 × Do |
| Tip of Second Conduit | 0 to 1.0 × Do; such as about 0 to 0.5 × Do |
| Tip of Third Conduit | 0 to 1.0 × Do; such as about 0 to 0.5 × Do |

In one embodiment, a diverging frustoconical discharge zone may be provided near the downstream end of the burner by progressively retracting the tips of the central, second and third conduits. In such case, the retraction of the tip of the central conduit may be the same as that for the tip of the second conduit, or more. In this embodiment a small amount of mixing may take place at or just prior to the outer conduit exit orifice. Further, a high bulk velocity of the mixture of slurry of solid carbonaceous fuel and free-oxygen containing gas optionally in admixture with temperature moderator is maintained across the exit orifice of the burner.

In one embodiment, the downstream end of the burner is a converging frustoconical section. The central longitudinal axis of the burner intersects a plane tangent to the external surface of the frustoconical section of the outer conduit at an angle in the range of about 15° to 60°, such as about 20° to 40°.

By tapering the downstream end of the burner, the massiveness of the burner is reduced so that heat absorption from the hot recirculating gases at the end of the burner is minimized. The size of the annular cooling chamber at the tip of the burner, and the size of the cooling coil encircling the burner at the downstream end may be reduced. Further, the annular cooling chamber may have an elliptical cross-section. The major axis of the ellipse extends rearwardly; and, there is substantially no bulge beyond the tip of the burner. Advantageously, by this design, the quantity of cooling water is thereby reduced. Further, the exposed surface area at the tip of the burner is minimized so that there is substantially no soot and/or slag build-up at the tip of the burner.

The velocity of the gaseous streams (with or without admixture with a temperature moderator) passing through the central conduit and the second and outer annular passages of the subject burner is in the range of about 76 feet per second to sonic velocity, say about 150–750 feet per second. The velocity of the stream of liquid slurry of solid carbonaceous fuel passing through the first annular passage is in the range of about 1–50, say about 10–25 feet per second. The velocity of each gaseous stream is at least 75 feet per second greater than the velocity of the liquid slurry stream.

All of the free-oxygen containing gas may be split up between two or three streams. Thus, three separate portions of free-oxygen containing gas may be passed through the central conduit, and the second and outer annular passages. Alternatively, separate portions of the free-oxygen containing gas may be passed through the second and outer annular passages, and no free-oxygen containing gas is passed through the central conduit. In such case, a gaseous stream selected from the group consisting of steam, recycle product gas and hydrocarbon gas is passed through the central conduit.

In the embodiment where all of the free-oxygen containing gas is passed through the central conduit and the second and outer annular passages, the total flow of the free-oxygen containing gas through the burner may be split between said conduit and passages as follows (in volume %): central conduit—about 5 to 60, such as about 10 to 20; second annular passage—about 5 to 85, such as about 20 to 45; and outer annular passage—about 5 to 85, such as about 20 to 45. A selection of the amount of free-oxygen containing gas passing through each conduit or passage is made so that 100% of the flow of free-oxygen containing gas passes through the burner. In one embodiment, a large increase in atomization efficiency was observed as the percentage of the gas passing through the central conduit increased up to about 10%. Beyond that amount, little or no further increase in atomization efficiency was observed.

The ratio of the cross sectional area for the second annular passage divided by the cross sectional area for the outer annular passage is in the range of about 0.50 to 2, such as about 1.0 to 1.5.

In the operation of the burner, flow control means may be used to start, stop and regulate the flow of the four feedstreams to the passages in the burner. The feedstreams entering the burner and simultaneously and concurrently passing through at different velocities impinge and mix with each other just prior to, at, or downstream from the downstream tip of the burner. The impingement of one reactant stream, such as the liquid slurry of solid carbonaceous fuel in a liquid medium with another reactant stream, such as a gaseous stream of free-oxygen containing gas optionally in admixture with a temperature moderator at a higher velocity, causes the liquid slurry to break up into a fine spray. A multiphase mixture is produced in the reaction zone.

During operation of the partial oxidation gas generator, it may be necessary to rapidly turndown the production of the effluent gas to less than the plant design output, without replacing the burner. Changing the burner requires a costly shut-down period with resultant delay. Thus, in combined cycle operation for power generation a durable burner is required which offers minimum pressure drop and with which throughput levels may be rapidly changed—up and down—without sacrificing stable operation and efficiency. Further, the burner should operate with slurries of solid carbonaceous fuel. These requirements have been fulfilled with the subject burner. Combustion instability and poor efficiency can be encountered when prior art burners are used for the gasification of liquid phase slurries of solid carbonaceous fuels. Further, feedstreams may be poorly mixed and solid fuel particles may pass through the gasifier without contacting significant amounts of oxygen. Unreacted oxygen in the reaction zone may then react with the product gas. Further, soot and slag build-up on the flat surfaces surrounding the discharge orifices at the face of the prior art burners would interfere with the flow pattern of the reaction components at the exit of the burner. These problems and others are avoided by the subject burner.

The rate of flow for each of the streams of free-oxygen containing gas is controlled by a flow control valve in each feedline to the burner. The rate of flow for the pumpable slurry of solid carbonaceous fuel is controlled by a speed controlled pump located in the feedline to the burner. Turndown or turnup of the burner is effected by changing the rate of flow for each of the streams while maintaining substantially constant the atomic oxygen to carbon ratio and the $H_2O$ to fuel weight ratio. By adjusting the flow control valve in each feedline for each free-oxygen containing gas stream, a high pressure differential and high velocity is always maintained, even during turnup or turndown. Thus, the cylindrical shape slurry stream with the gaseous core that is discharged at the front portion of the burner is always impacted by at least one high velocity stream of free-oxygen containing gas prior to, at, or downstream from the tip of the burner. Efficient atomization of the slurry stream and intimate mixing of the slurry and free-oxygen containing gas streams are thereby assured.

It is necessary to maintain at least some nominal flow velocity, e.g. at least 25 feet per second, in the turned down annular passage in order to prevent slurry from entering it. At turndown ratios above 50%, such as about 75% of the design flow rate, in one embodiment where there is sufficient pressure drop available, the free-oxygen containing gas may be split so that the velocity flowing in the second or outer annular passage is greater than the design velocity. Preferably, the velocity is greatest for the free-oxygen containing gas flowing through the second annular passage. This passage is next to the first annular passage through which the slurry stream flows.

Typical % of design rates, volume % and stream velocities in feet per second, are shown in Table II below for turning down the capacity of one embodiment of the subject burner from 100 to 50% of design. Turndown has little effect on the free-oxygen containing gas which impacts the slurry and therefore atomization efficiency, since the velocity of at least one free-oxygen containing gas stream flowing through the burner is high. Further, the bulk velocity of the free-oxygen containing gas and slurry passing through the second conduit exit orifice of this embodiment remains reasonably high.

TABLE II

| | Burner Turndown | | | | | |
|---|---|---|---|---|---|---|
| | Central Conduit-Free-$O_2$ Stream | Second Annular Passage-Free-$O_2$ Stream | Second Conduit Exit Orifice | Outer Annular Passage-Free-$O_2$ Stream | Outer Conduit Exit Orifice | First Annular Passage-Slurry Stream |
| 100% Design Rate, Vol % | 10 | 45 | 100 | 45 | 100 | 100 |
| Velocity, ft./sec. | 450 | 450 | 200 | 450 | 200 | 10 |
| 50% Design Rate, Vol % | 5.0 | 40 | 50 | 5.0 | 50 | 50 |
| Velocity, ft./sec. | 225 | 400 | 163.6 | 50 | 100 | 5 |
| 75% Design Rate, Vol % | 7.5 | 45.0 | 75 | 22.5 | 75 | 75 |
| Velocity, ft./sec. | 337.50 | 450.0 | 190.9 | 225 | 150 | 7.5 |
| 75% Design Rate, Vol % | 7.5 | 10.6 | 75 | 56.9 | 75 | 75 |
| Velocity, ft./sec. | 337.50 | 106 | 65.8 | 569 | 150 | 7.5 |

Burning of the combustible materials while passing through the burner may be prevented by discharging the reactant feedstreams at the central and annular exit orifices at the tip of the burner with a discharge velocity which is greater than the flame propagation velocity. Flame speeds are a function of such factors as composition of the mixture, temperature and pressure. They may be calculated by conventional methods or determined experimentally. Advantageously, by means of the subject burner, the exothermic partial oxidation reactions take place a sufficent distance downstream from the burner face so as to protect the burner from thermal damage.

The subject burner assembly is inserted downward through a top inlet port of a compact unpacked free-flow noncatalytic refractory lined synthesis gas generator, for example as shown in coassigned U.S. Pat. No. 3,544,291. The burner extends along the central longitudinal axis of the gas generator with the downstream end discharging directly into the reaction zone. The relative proportions of the reactant feedstreams and optionally temperature moderator that are introduced into the gas generator are carefully regulated to convert a substantial portion of the carbon in the fuel e.g., up to about 90% or more by weight, to carbon oxides; and to maintain an autogenous reaction zone temperature in the range of about 1700° to 3500° F., preferably in the range of 2000° to 2800° F.

The dwell time in the reaction zone is in the range of about 1 to 10 seconds, and preferably in the range of about 2 to 8. With substantially pure oxygen feed to the gas generator, the composition of the effluent gas from the gas generator in mole % dry basis may be as follows: $H_2$ 10 to 60; CO 20 to 60; $CO_2$ 5 to 40; $CH_4$ 0.01 to 5; $H_2S+COS$ nil to 5; $N_2$ nil to 5; and A nil to 1.5. With air feed to the gas generator, the composition of the generator effluent gas in mole % dry basis may be about as follows: $H_2$ 2 to 30; CO 5 to 35; $CO_2$ 5 to 25; $CH_4$ nil to 2; $H_2S+COS$ nil to 3; $N_2$ 45 to 80; and A 0.5 to 1.5. Unconverted particulate carbon-soot, ash, slag, or mixtures thereof are contained in the effluent gas stream.

Pumpable slurries of solid carbonaceous fuels having a dry solids content in the range of about 30 to 75 wt.%, say about 40 to 70 wt.% may be passed through the inlet passage of the first annular conduit in the subject burner. The inlet temperature of the slurry is in the range of about ambient to 500° F., but, preferably below the vaporization temperature of the carrier for the solid carbonaceous fuel at the given inlet pressure in the range of about 1 to 300 atmospheres, such as 5 to 250 atmospheres, say about 10 to 100 atmospheres.

The term solid carbonaceous fuels, as used herein to describe suitable solid carbonaceous feedstocks, is intended to include various materials and mixtures thereof from the group consisting of coal, coke from coal, char from coal, coal liquefaction residues, petroleum coke, particulate carbon soot, and solids derived from oil shale, tar sands, and pitch. All types of coal may be used including anthracite, bituminous, sub-bituminous, and lignite. The particulate carbon soot may be that which is obtained as a byproduct of the subject partial oxidation process, or that which is obtained by burning fossil fuels. The term solid carbonaceous fuel also includes by definition bits of garbage, dewatered sanitary sewage, and semi-solid organic materials such as asphalt, rubber and rubber-like materials including rubber automobile tires.

The solid carbonaceous fuels are preferably ground to a particle size so that 100% of the material passes through an ASTM E 11-70 Sieve Designation Standard 1.40 mm (Alternative No. 14) and at least 80% passes through an ASTM E 11-70 Sieve Designation Standard 425 mm (Alternative No. 40). The moisture content of the solid carbonaceous fuel particles is in the range of about 0 to 40 wt.%, such as 2 to 20 wt.%.

The term liquid carrier, as used herein as the suspending medium to produce pumpable slurries of solid carbonaceous fuels is intended to include various materials from the group consisting of water, liquid hydrocarbonaceous materials, and mixtures thereof. However, water is the preferred carrier for the particles of solid carbonaceous fuel. In one embodiment, the liquid carrier is liquid carbon dioxide. In such case, the liquid slurry may comprise 40–70 wt.% of solid carbonaceous fuel and the remainder is liquid $CO_2$. The $CO_2$-solid fuel slurry may be introduced into the burner at a temperature in the range of about −67° F. to 100° F. depending on the pressure.

The term free-oxygen containing gas, as used herein, is intended to include air, oxygen-enriched air, i.e., greater than 21 mole % oxygen, and substantially pure oxygen, i.e., greater than 95 mole % oxygen, (the remainder comprising $N_2$ and rare gases).

Simultaneously with the fuel stream, the plurality of streams of free-oxygen containing gas are supplied to the reaction zone of the gas generator at a temperature in the range of about ambient to 1500° F., and preferably in the range of about ambient to 300° F., for oxygen-enriched air, and about 500° to 1200° F., for air. The pressure is in the range of about 1 to 300 atmosphere such as 5 to 250 atmosphere, say 10 to 100 atmospheres. The atoms of free-oxygen plus atoms of organically combined oxygen in the solid carbonaceous fuel per atom of carbon in the solid carbonaceous fuel (O/C atomic ratio) may be in the range of about 0.5 to 1.95.

The term temperature moderator as employed herein includes water, steam, $CO_2$, $N_2$, and a recycle portion of the product gas stream. The temperature moderator may be in admixture with the fuel stream and/or the oxidant stream.

The term hydrocarbon gas as used herein includes methane, ethane, propane, butane, and natural gas.

In one embodiment, the feedstream comprises a slurry of liquid hydrocarbonaceous material and solid carbonaceous fuel. $H_2O$ in liquid phase may be mixed with the liquid hydrocarbonaceous carrier, for example as an emulsion. A portion of the $H_2O$ i.e., about 0 to 25 wt.% of the total amount of $H_2O$ present may be introduced as steam in admixture with the free-oxygen containing gas. The weight ratio of $H_2O$/fuel may be in the range of about 0 to 5, say about 0.1 to 3.

The term liquid hydrocarbonaceous material as used herein to describe suitable liquid carriers is intended to include various materials, such as liquified petroleum gas, petroleum distillates and residues, gasoline, naphtha, kerosine, crude petroleum, asphalt, gas oil, residual oil, tar sand oil and shale oil, coal derived oil, aromatic hydrocarbon (such as benzene, toluene, xylene fractions), coal tar, cycle gas oil from fluid-catalytic-cracking operation, furfural extract of coker gas oil, methanol, ethanol and other alcohols and by-product oxygen containing liquid hydrocarbons from oxo or oxyl synthesis, and mixtures thereof.

DESCRIPTION OF THE DRAWING

A more complete understanding of the invention may be had by reference to the accompanying schematic drawing which shows the subject invention in detail. Although the drawing illustrates a preferred embodiment of the invention, it is not intended to limit the subject invention to the particular apparatus or materials described.

Referring to FIG. 1, a high turndown burner assembly is depicted. Burner 1 is installed with downstream end 2 passing downwardly through a port in the top of a free-flow partial oxidation synthesis gas generator (not shown). The longitudinal central axis of burner 1 is preferably aligned along the central axis of the synthesis gas generator by means of mounting flange 3. Burner 1 comprises central, second, third and outer concentric cylindrically shaped conduits 8, 9, 10 and 11 respectively. An annular coaxial water-cooled annular ring 12 is located at the downstream extremity of the burner. External cooling coils 13 may encircle the downstream end of burner 1. Flanged inlet pipes 20–23 for the feedstreams to the burner are connected to central conduit 8, and concentric cylindrical conduits 9, 10 and 11, respectively.

The burner has three unobstructed annular passages for the free-flow of the feedstreams. The annular passages are formed by radially spacing the four conduits. Thus, first annular passage 25 is located between the outside diameter of central conduit 8 and the inside diameter of second conduit 9. The radial spacing between the central and second conduits is maintained by wall spacers 26. Second annular passage 27 is located between the outside diameter of second conduit 9 and the inside diameter of third conduit 10. Wall spacers 28 maintain the radial spacing between the second and third conduits. Outer annular passage 29 is located between the outside diameter of third conduit 10 and the inside diameter of outer conduit 11. Wall spacers 31 maintain the radial spacing between the third conduit 10 and outer conduit 11.

The upstream ends of each conduit and annular passage is closed off, cover plates 35 to 38 seal off the upstream ends of central conduit 8, annular passage 25 and second conduit 9, annular passage 27 and third conduit 10, and outer annular passage 29 and outer conduit 11, respectively. Conventional means may be used to secure the cover plate to the ends of the conduit e.g., flanging, welding, threading. Gasketing may be used to provide a leak-proof seal.

At the downstream end of the burner, the outside diameters of central conduit 8 and second conduit 9 are gradually reduced, for example about 30–50%, and develop into right cylindrical portions 40 and 41, respectively. Right annular passage 42 is located between right cylindrical portions 40 and 41. Tips 45, 44, and optionally 43 of third conduit 10, second conduit 9, and central conduit 8, respectively may be progressively retracted upstream from tip 46 of outer conduit 11 and cooling ring 12 at the tip of the burner to provide a diverging frustoconical area 47, as shown in the drawing. Alternatively, tips 43, 44, 45, and 46 may terminate in the same plane perpendicular to the central longitudinal axis of the burner at the downstream tip of the burner. Preferably, the foremost portion of cooling chamber 12 terminates in the same perpendicular plane as tip 46.

The feedstreams are introduced into the burner through separate feedlines connected to flanged inlet pipes 20–23 in the upstream end of burner 1. Thus, a gaseous material from the group free-oxygen containing gas, steam, recycle product gas, and hydrocarbon gas is passed through line 55, flow control valve 56, line 57, and inlet pipe 20. A pumpable liquid phase slurry of solid carbonaceous fuel, for example a coal-water slurry, is passed through line 58, flow control means 59, line 60, and inlet pipe 21. Two separate streams of free-oxygen containing gas optionally in admixture with a temperature moderator are respectively passed through line 61, flow control valve 62, line 63, and inlet pipe 22; and line 64, flow control valve 65, line 66, and inlet pipe 23.

Other modifications and variations of the invention as hereinbefore set forth may be made without departing from the spirit and scope thereof, and therefore only such limitations should be imposed on the invention as are indicated in the appended claims.

I claim:

1. In a continuous process for the manufacture of gas mixtures comprising $H_2$ and CO and containing at least one material from the group $CO_2$, $H_2O$, $N_2$, $CH_4$, $H_2S$ and COS, and entrained matter by the partial oxidation of a feedstream comprising a pumpable slurry of solid carbonaceous fuel in a liquid carrier and a feedstream of free-oxygen containing gas optionally in admixture with a temperature moderator, said partial oxidation occurring in the reaction zone of a free-flow gas generator at an autogenous temperature in the range of about 1700° to 3500° F., and a pressure in the range of about 5 to 250 atmospheres, the improvement which comprises:

(1) passing a stream of gaseous material from the group consisting of free-oxygen containing gas, steam, recycle product gas, and hydrocarbon gas through the central conduit of a burner mounted in the upper portion of said gas generator at a velocity in the range of about 76 feet per second to sonic velocity, said burner comprising radially spaced concentric central, second, third, and outer cylindrical conduits providing therebetween first, second, and outer concentric annular passages, said conduits and passages being closed at their upstream ends where feedstream inlets are provided and open at their downstream exit orifices for discharge;

(2) simultaneously passing a pumpable slurry stream of solid carbonaceous fuel in a liquid carrier through said first annular passage at a velocity in the range of about 1 to 50 feet per second;

(3) simultaneously passing a stream of free-oxygen containing gas through said second and outer annular passages at a velocity in the range of about 76 feet per second to sonic velocity;

(4) mixing said feedstreams together prior to, at, or downstream from the outer conduit exit orifice to produce a mixture whose atoms of free-oxygen plus atoms of organically combined oxygen in the solid carbonaceous fuel per atoms of carbon in the solid carbonaceous fuel is in the range of about 0.5 to 1.95, and the weight ratio of $H_2O$/ fuel is in the range of about 0.1 to 3; and (5) reacting by partial oxidation the mixture from (4) in said reaction zone to produce said gas mixture.

2. The process as described in claim 1 wherein the central conduit has a converging nozzle that develops into a right cylindrical section of smaller diameter near the downstream end, a converging frustoconical annular portion that develops into a right cylindrical annular portion is near the downstream end of the first annular passage, converging frustoconical annular portions are near the downstream ends of the second and outer annular passages, and a cylindrical shaped slurry stream with a gaseous core is discharged at the front portion of the burner where it is impacted by at least one high velocity stream of free oxygen containing gas prior to, at, or downstream from the tip of the burner.

3. The process of claim 1 wherein the retractions upstream from the outer conduit exit orifice (Do) at the tip of the burner for the tip of the central conduit is in the range of up to $1.0 \times Do$, and for the tips of the second and third conduits are in the range of up to $0.5 \times Do$, to provide a diverging frustoconical discharge zone prior to the downstream tip of the burner, and a high bulk velocity of the mixture is maintained across the exit orifice of the burner.

4. The process of claim 1 provided with the steps of splitting all of the free-oxygen containing gas into three streams, and passing 10 volume % through the central conduit, and dividing the remainder between said second and outer annular passages.

5. The process as described in claim 1 wherein said pumpable slurry of solid carbonaceous fuel in a liquid carrier comprises a solid carbonaceous fuel selected from the group consisting of coal, lignite, coke from coal, char from coal, coal liquefaction residues, petroleum coke, particulate carbon-soot, and solids derived from oil shale, tar sands, pitch, bits of garbage, dewatered sanitary sewage, and semisolid organic materials such as asphalt, rubber and rubber-like materials including rubber automobile tires; and a liquid carrier selected from the group consisting of water, liquid hydrocarbonaceous materials, and mixtures thereof; and said free-oxygen containing gas is selected from the group consisting of air, oxygen-enriched air, and substantially pure oxygen.

6. The process of claim 1 wherein the velocity of each gaseous stream, with or without admixture with a temperature moderator, passing through the central conduit and the second and outer annular passages of the burner is at least 75 feet per second greater than the velocity of the liquid slurry stream passing through the first annular passage.

7. The process of claim 1 provided with the additional steps for turning down or up the flow rate of said burner to a desired percentage of the design flow rate for which the burner was originally designed comprising (a) adjusting the flow rate of the stream of gaseous material in step (1) and the flow rate of the pumpable slurry stream of solid carbonaceous fuel in step (2) so that the flow rate for each of said streams is substantially equal to its respective design flow rate times said desired percentage; and (b) simultaneously varying the flow rates of each of the streams of free-oxygen containing gas in step (3) so that the total rate of flow for all of the free-oxygen containing gas streams flowing through the burner is substantially equal to the sum of the individual design flow rates for each of said free-oxygen containing gas streams flowing through the burner times said desired percentage.

8. The process of claim 7 wherein the velocity of the gaseous stream in (a) and at least one of the streams of free-oxygen containing gas in (b) is at least 75 feet per second greater than the velocity of the liquid slurry stream.

9. The process of claim 7 wherein the flow rates of the streams are adjusted in (a) and (b) while maintaining substantially constant the atomic oxygen to carbon ratio and the $H_2O$ to fuel weight ratio.

10. The process of claim 7 wherein the flow rate of said burner is turned down and the velocities of the free-oxygen containing gas streams flowing through the second and outer annular passages in step (3) are maintained at sufficient values to prevent slurry from entering either annular passage.

11. The process of claim 1 wherein said burner is provided with a separate inlet means in communication with each of the upstream ends of each of said cylindrical conduits and annular passages, a separate feedstream conduit externally connected to each of said inlet means, and a separate flow rate control means in each of said feedstream conduits for controlling the flow rate of the feedstream passing through said feedstream conduit, and wherein from about 5 to 60 volume % of the total free-oxygen containing gas, with or without admixture with a temperature moderator, is passed through the central conduit, and the remainder of the free-oxygen containing gas, with or without admixture with a temperature moderator, is split into separate streams and simultaneously passed through the second and outer annular passages, and provided with the additional steps for turning down the flow rate of said burner to a desired percentage of the design flow rate for which the burner was originally designed comprising (a) adjusting the respective flow rate control means so as to reduce the rate of flow to substantially equal the design rate of flow times said desired percentage for the stream of free-oxygen containing gas, with or without admixture with a temperature moderator, flowing through the central conduit and for the slurry stream of solid carbonaceous fuel flowing through the first annular passage; and (b) simultaneously adjusting the respective flow rate control means for each of the streams of free-oxygen containing gas, with or without admixture with a temperature moderator, flowing through the second and outer annular passages so that the total rate of flow for all of the streams of free-oxygen containing gas, with or without admixture with a temperature moderator, flowing through the burner is substantially equal to the sum of the individual design flow rates for each of the streams of free-oxygen containing gas, with or without admixture with a temperature moderator, flowing through the burner times said desired percentage, while maintaining the velocity of each stream of free-oxygen containing gas, with or without admixture with a temperature moderator, flowing through the central conduit and through at least one of the annular passages at a value which is at least 75 feet per second greater than the velocity of the slurry stream of solid carbonaceous fuel flowing through the first annular passage, and while maintaining the velocity of each stream of free-oxygen containing gas, with or without admixture with a temperature moderator, flowing through said second and outer annular passage at a sufficient level to prevent slurry from entering either annular passage.

12. The process of claim 11 wherein the flow rate adjustments in (a) and (b) are made while maintaining substantially constant the atomic oxygen to carbon ratio and the $H_2O$ to fuel weight ratio.

13. The process of claim 11 wherein the velocity of the free-oxygen containing gas stream, with or without admixture with a temperature moderator, flowing through the second annular passage is greater than the velocity of the other streams.

14. The process of claim 11 wherein the throughput of said burner is turned down to a preselected reduced percentage of design in the range from 100 to 50%.

* * * * *